US005881024A

United States Patent [19]

Nishimura et al.

[11] Patent Number: 5,881,024

[45] Date of Patent: Mar. 9, 1999

[54] COMBINATION DISPLAY TIMEPIECE EQUIPPED WITH EL ILLUMINATION

[75] Inventors: Katsuo Nishimura; Yuichi Kamei, both of Tanashi, Japan

[73] Assignee: Citizen Watch Co., Ltd., Tokyo, Japan

[21] Appl. No.: 860,056

[22] PCT Filed: Oct. 16, 1996

[86] PCT No.: PCT/JP96/02989

§ 371 Date: Jun. 16, 1997

§ 102(e) Date: Jun. 16, 1997

[87] PCT Pub. No.: WO97/14997

PCT Pub. Date: Apr. 24, 1997

[30] Foreign Application Priority Data

Oct. 17, 1995 [JP] Japan ..... 7-268143

[51] Int. Cl.[6] ..... G04B 19/30; G04B 19/04; G04C 19/00

[52] U.S. Cl. ..... 368/67; 368/80; 368/84; 368/227

[58] Field of Search ..... 368/67, 71, 80, 368/82, 84, 223, 226–228; 362/23, 26–29, 24, 62, 84

[56] References Cited

U.S. PATENT DOCUMENTS 4,312,056 1/1982 Nishimura ..... 368/62
4,413,915 11/1983 Besson ..... 368/11
4,775,964 10/1988 Alessio et al. ..... 368/67

FOREIGN PATENT DOCUMENTS 55-96481 7/1980 Japan .
55-134383 10/1980 Japan .
57-122590 1/1981 Japan .
57-29878 1/1981 Japan .
6-18986 3/1994 Japan .
6-80196 11/1994 Japan .

*Primary Examiner*—Vit Miska
*Attorney, Agent, or Firm*—Kanesaka & Takeuchi

[57] ABSTRACT

A timepiece is equipped with a hand shaft display portion having hands and driving shafts for the hands, and a liquid crystal display portion situated above a substrate. A liquid crystal display portion support frame is situated above the substrate for supporting the liquid crystal display portion. The liquid crystal display portion support frame includes a shaft insertion hole for allowing the driving shafts to pass therethrough, a penetration window located away from the shaft insertion hole and facing the liquid crystal display portion, and a light transmission member formed at least around the shaft insertion hole. An EL element is situated under the liquid crystal display portion support frame relative to the hands. The EL element illuminates the liquid crystal display portion and the hand shaft display portion through the light transmission member when the EL element is illuminated.

10 Claims, 4 Drawing Sheets

COMBINATION DISPLAY TIMEPIECE EQUIPPED WITH EL ILLUMINATION

FIELD OF THE INVENTION

This invention relates to a combination display timepiece equipped with EL illumination including a hand shaft display portion and a liquid crystal display portion.

DESCRIPTION OF THE BACKGROUND ART

Generally, a watch including a hand shaft display portion for indicating time analogously by hand positions and a liquid crystal display portion for indicating time digitally due to an electro-optic effect is known as a multiple display watch.

As an example of a multiple display watch of this type, disclosed by the present inventors in Japanese Patent Publication No. 16389/1987 is an illuminated multiple display watch equipped with a miniature lamp for illuminating a time display so that the current time can be viewed under dark conditions such as at night or the like.

With such an illuminated multiple display watch, however, there are difficulties in uniformly illuminating an entire display. Therefore, an improvement in such difficulties has been needed.

On the other hand, the progress in the technology for illumination using an electroluminescent (hereinafter abbreviated as "EL") element has allowed development of EL illuminated display watches using an EL element.

Conventionally, such EL illuminated display watches (1) as disclosed in Japanese Utility Models Laid-open No. 188633/1988, No. 45883/1989, and No. 80197/1994 are known.

Also, the EL illuminated display watches conventionally used include watches (2) of the types disclosed in Japanese Utility Models Laid-open No. 18986/1994 and No. 294668/1995.

In these watches, each whole time display can be uniformly illuminated.

However, the former (display watches (1)) aims at an EL illuminated display watch equipped with a digital display, whereas the latter (display watches (2)) aims at an EL illuminated display watch equipped with an analog display.

Because of this, it has been desired to realize a combination display timepiece equipped with EL illumination which is equipped with both an analog display and a digital display to be illuminated.

The watches shown in FIGS. 7 and 8 satisfy such a demand.

First, the combination display timepiece equipped with EL illumination shown in FIG. 7 will be illustrated with reference to the drawing.

FIG. 7 is a sectional view showing the major portion of an internal mechanism (module) of a conventional combination display timepiece equipped with EL illumination, in which the casing for the watch, the inside of the movement, and the like are omitted.

In FIG. 7, the symbol 11 represents a hand shaft display portion for indicating time analogously, including hands 12 representing a long hour hand and a short minute hand and a hand shaft 13 as a driving shaft for the hands 12. The hands 12 are rotated by driving the movement 14 to indicate the time. The movement 14 consists of a step motor, a reduction train wheel, and the like, though these are not shown. By these measures, the driving force of the step motor is transferred to the hands 12 via the hand shaft 13.

The symbol 15 represents a liquid crystal display portion for indicating time digitally, including two glass substrates 16, 17 which are stacked in the vertical direction (axial direction of the hand shaft 13) and a liquid crystal (not shown) sealed between the glass substrates 16, 17. The time is displayed by the electro-optic effect of the liquid crystal, which is controlled by the voltage to be applied. A twisted nematic (hereinafter abbreviated as "TN") liquid crystal is used as the liquid crystal. A deflecting plate is used in this TN liquid crystal, though it is not shown.

The symbol 18 represents a liquid crystal display portion support frame for supporting the liquid crystal display portion 15. The liquid crystal display portion support frame 18 is disposed on a circuit substrate 19. An electroconductive rubber 20 is pressure-welded on the circuit substrate 19 by this support frame 18 via the upper glass substrate 16. The liquid crystal display portion support frame 18 includes a first penetration window 18*a* facing the liquid crystal display portion 15 and a second penetration window 18*b* into which the hand shaft 13 is inserted and facing the movement 14. On the circuit substrate 19, an IC, a crystal vibrator, a pressure-up circuit, and the like are mounted. The electroconductive rubber 20 is compressed in the direction parallel to the each axis of the penetration windows 18*a*, 18*b*. The two terminals of the electroconductive rubber 20 are electrically connected to an electrode output portion 16*a* and an electrode 19*a* of the circuit substrate 19 respectively.

The symbol 21 represents an EL film for illuminating the liquid crystal display portion 15 from below. The EL film 21 is disposed between the lower glass substrate 17 and the circuit substrate 19 and is electrically connected to the circuit substrate 19 through a pressure coil spring 22. The EL film 21 is turned on and off by a switch (hereinafter abbreviated as "SW"), though not shown.

The symbol 23 represents a dial constituting a part of the hand shaft display portion 11. The dial 23 is disposed between the hands 12 and the liquid crystal display portion support frame 18. The dial 23 is provided with a shaft through hole 23*a*, into which the hand shaft 13 is inserted and a insertion hole 23*b* which faces the liquid crystal display portion 15. The liquid crystal display portion 15 can be viewed from above through the penetration window 23*b* of the dial 23 and the first penetration window 18*a* of the liquid crystal display portion support frame 18. Also, the dial 23 shields the electroconductive rubber 20 so that the electroconductive rubber 20 cannot be viewed from above (hand side).

In a combination display timepiece equipped with EL illuminationes formed in the above manner, the movement 14 is driven by a signal from a source transmitter and the driving force is transferred to the hands 12 through the hand shaft 13, thereby indicating the time analogously. In the same way, a voltage is applied to the liquid crystal display portion 15 from the circuit substrate 19 through the electroconductive rubber 20 by a signal from a source transmitter, thereby indicating the time digitally.

By these measures, the hand shaft display portion 11 and the liquid crystal display portion 15 can be viewed to determine the time in general under the condition where the EL film is turned off. Also, even in the case of a dark condition such as at night or the like, the liquid crystal display portion 15 can be viewed to determine the time under the condition where the EL film 21 is turned on by the SW (not shown).

Next, the combination display timepiece equipped with EL illumination shown in FIG. 8 will be illustrated with reference to the drawing.

FIG. 8 is a sectional view showing the major portion of an internal mechanism (module) of a conventional combination display timepiece equipped with EL illumination, in which the parts other than a full liquid crystal display portion, a liquid crystal display portion support frame, an El element, and a dial are represented by the same symbols as in FIG. 7, therefore detailed descriptions are omitted. Also, in FIG. 8, the casing for the watch, the inside of the casing, and the like are omitted.

In FIG. 8, the symbol 35 represents a full liquid crystal display portion for indicating time digitally, including two glass substrates 36, 37 which are stacked in the vertical direction arid a liquid crystal (not shown) sealed between the glass substrates 36, 37. The time is displayed by the electro-optic effect of the liquid crystal, which is controlled by the voltage applied. As the liquid crystal, a TN liquid crystal is used in the same way as in FIG. 7. In this TN liquid crystal, a deflecting plate is used generally, though it is omitted in the same way as in FIG. 7. The full liquid crystal display portion 35 is formed of a display of a plane shape such as a square shape, an octagonal shape, or the like. Also, a shaft insertion hole 35*a* for inserting a hand shaft 13 is provided in the center of the liquid crystal display portion 35.

The symbol 38 represents a liquid crystal display portion support frame for supporting the full liquid crystal display portion 35. The liquid crystal display portion support frame 38 is disposed on a circuit substrate 19. An electroconductive rubber 20 is pressure-welded on the circuit substrate 19 by this support frame 38 via the upper glass substrate 36. In the center of the liquid crystal display portion support frame 38, a penetration window 38*a* is provided into which the hand shaft 13 is inserted and which faces the full liquid crystal display portion 35. The electroconductive rubber 20 is compressed in the direction parallel to the axis of the penetration window 38*a*. The two terminals of the electroconductive rubber 20 are electrically connected to an electrode output portion 36*a* of the upper glass substrate 36 and an electrode 19*a* of the circuit substrate 19 respectively.

The symbol 41 represents an EL film for illuminating the entire liquid crystal display portion 35 from below (opposite to the hand side). The EL film 41 is disposed between the lower glass substrate 37 and the movement 14 and electrically connected to the circuit substrate 19 through a pressure coil spring 22. The EL film 41 is formed of a film with almost the same plane shape as that of the full liquid crystal display portion 35 and which is turned on and off by an SW, though not shown. In the center of the EL film 41, a shaft through-hole 41*a* for inserting the hand shaft 13 is provided.

The symbol 43 represents a dial constituting a part of a hand shaft display portion 11. The dial 43 has a penetration window 43*a* which faces the full liquid crystal display portion 35 and is disposed around the hand 12. The liquid crystal display portion 35 and the hand 12 can be viewed from above through the penetration window 43*b* of the dial 43. Also, the dial 43 shields the electroconductive rubber 20 so that the electroconductive rubber 20 cannot be viewed from above (hand side).

In the combination display timepiece equipped with EL illumination formed in the above manner, the movement 14 is driven by a signal from a source transmitter and the driving force is transferred to the hand 12 through the hand shaft 13, thereby indicating the time analogously. A voltage is applied to the full liquid display 35 from the circuit substrate 19 through the electroconductive rubber 20 by a signal from a source transmitter, thereby indicating the time digitally in the same manner as in the combination display timepiece equipped with EL illumination shown in FIG. 7.

By these measures, the hand shaft display portion 11 and the liquid crystal display portion 35 can be viewed to determine the time in general under the condition where the EL film 41 is turned off. Also, even in the case of dark conditions such as at night or the like, the liquid crystal display portion 35 can be viewed to determine the time by either illuminating light or leak light obtained by turning on the EL film 41.

In the combination d splay timepiece equipped with EL illumination shown in FIG. 7, the liquid crystal display portion 15 can be viewed to determine the time, because the liquid crystal display portion is illuminated with light obtained by turning on the EL film 21. However, because this multiple display has a structure in which the liquid crystal display portion support frame 18 is interspaced between the hand 12 and the EL film 21, the light irradiated from the EL film 21 is cut by the liquid crystal display portion support frame 18 so that the light never reaches the hand 12. Hence, under dark conditions such as at night or the like, the time cannot be determined by the hand 12.

On the other hand, in the combination display timepiece equipped with EL illumination shown in FIG. 8, the full liquid crystal display portion 35 can be viewed to determine the time by the illuminating light obtained by turning on the EL film 41. Also, the full liquid crystal display portion 35 can be viewed to determine the time by the leaked light obtained by turning on the EL film 41. However, in the system adopting the full liquid crystal display portion 35, it is necessary to manufacture the shaft insertion hole 35*a* in the glass liquid crystal cell (full liquid crystal display portion 35) by mechanical processing, causing the processing cost to be high.

Also, the mechanical processing of the shaft insertion hole 35*a* causes a reduction in mechanical strength so that the impact resistance of the entire watch is impaired. As a result, a specific impact resistant structure is required, which causes high manufacturing costs.

Further, a wrist watch produced from the combination display timepiece equipped with EL illumination of the type using the full liquid crystal display portion 35 has the drawback that the illumination on an entire display is darkened because the full liquid crystal display portion 35 is covered with a deflecting plate. In addition, as the area occupied by the liquid crystal display portion of a watch increases, the configuration of the watch much resembles that of a watch of the type with digital display using a liquid crystal and hence the watch of the type using the liquid crystal display portion is lower in product value than the analog watch of the type using the hands for display.

As is clear from the above descriptions, in the conventional combination display timepiece equipped with EL illuminationes, the liquid crystal display portion 15 is illuminated by light emitted from the EL film 21 which is turned on. However, the hand shaft display portion 11 is never illuminated and hence the time is never determined by the analog display under dark conditions such as at night or the like. Also, though the full liquid crystal display portion 35 is illuminated by light emitted from the EL film 41 which is turned on, the hand shaft display portion 11 is only illuminated by its leaked light so that the hand shaft display portion 11 can be viewed sometimes only with difficulty under dark conditions such as at night or the like.

Also, for a watch of the type using the full liquid crystal display portion 35, the manufacturing and processing cost is high and the product value is reduced.

Accordingly, the present invention has been achieved in view of this situation and has an object of providing a combination display timepiece equipped with EL illumination comprising disposing an EL element for illuminating a hand shaft display portion and a liquid crystal display portion through a light transmission part of a liquid crystal display portion support frame at a position opposite a hand shaft display portion on a liquid crystal display portion support frame, the EL element being supported by the liquid crystal support frame at a position eccentric from the driving axis of a hand, with the time indicated by an analog display and a digital display under dark conditions such as at night or the like, attaining a reduction in the manufacturing and processing costs, and promoting the product value.

SUMMARY OF THE INVENTION

The above objects can be attained in the present invention by the provision of a combination display timepiece equipped with EL illumination comprising a hand shaft display portion for indicating time analogously by hands and a liquid crystal display portion for indicating time digitally, wherein:

the liquid crystal display portion is supported by a liquid crystal display portion support frame at a position eccentric from the driving axis of the hand;

the liquid crystal display portion support frame comprises a support frame including a shaft insertion hole for inserting the driving axis of the hands and a light transmission portion including a through-hole which faces the liquid crystal display portion; and an EL element for illuminating the hand shaft display portion and the liquid crystal display portion through the light transmission portion of the liquid crystal display portion support frame is disposed in a position opposite to the hands on the liquid crystal display portion support frame.

By these measures, both the hand shaft display portion and the liquid crystal display portion are illuminated uniformly and simultaneously. Also, the liquid crystal display portion is arranged in an area occupying a part of a watch display, which is different from a watch of the type provided with a liquid crystal display portion occupying almost all the area of a watch display.

DETAILED DESCRIPTION OF THE INVENTION AND PREFERRED EMBODIMENTS

The present invention will now be explained in detail.

Figure 1:
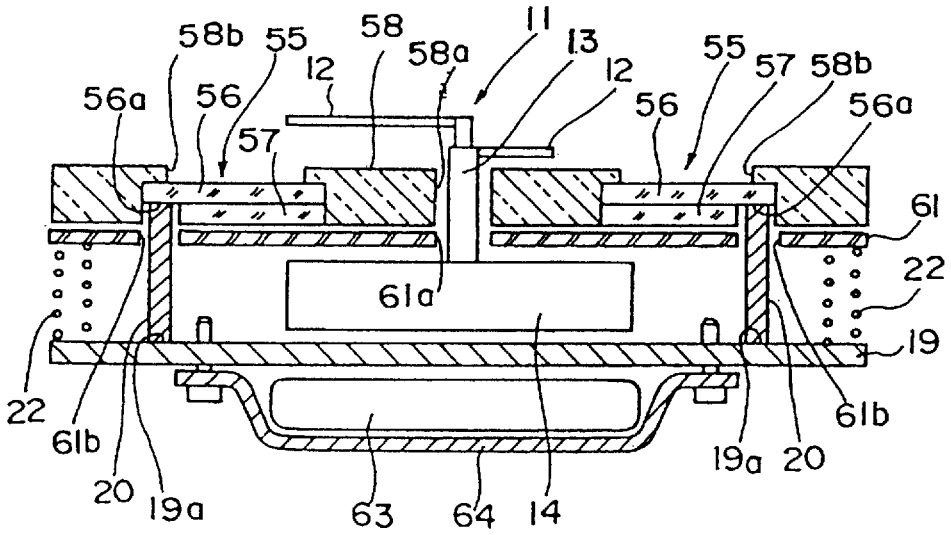
FIG. 1 is a sectional view showing a major part of an internal device (module) of a combination display timepiece equipped with EL illumination corresponding to a first embodiment of the present invention, in which the casing for the watch, the inside of the movement, and the like are omitted.
Figure 7:
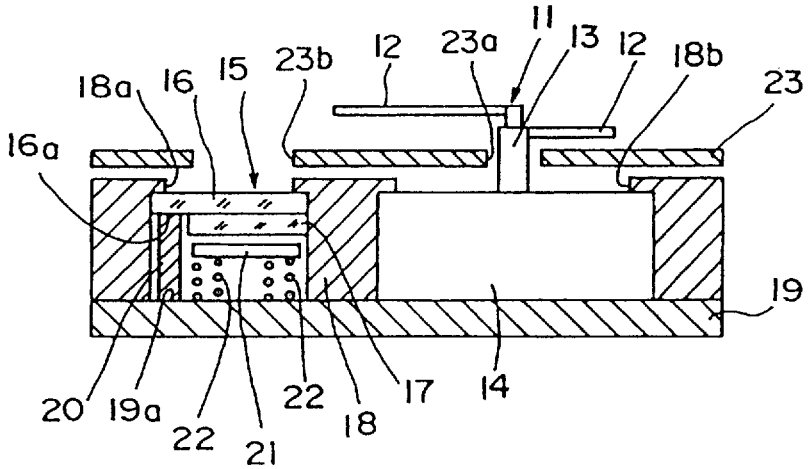
FIG. 7 Prior Art
FIG. 7 is a sectional view showing a major part of an internal device (module) of a combination display timepiece equipped with EL illumination corresponding to a first prior art, in which the casing for the watch, the inside of the movement, and the like are omitted.

FIG. 1 is a sectional view showing a major part of an internal device (module) of a combination display timepiece equipped with EL illumination corresponding to a first embodiment of the present invention, in which parts other than a liquid crystal display portion, a liquid crystal display portion support frame, an EL element, and a battery are represented by the same symbols as in FIG. 7. Therefore, detailed descriptions are omitted. Also, in FIG. 1, the casing for the watch, the inside of the movement, and the like are omitted.

In FIG. 1, the symbol 55 represents two liquid crystal display portions for indicating time digitally, including two glass substrates 56, 57 which are stacked in the vertical direction (direction parallel to the axis of a hand shaft) and a liquid crystal (not shown) sealed between these glass substrates 56, 57. The time is displayed by the electro-optic effect of the liquid crystal, which is controlled by the voltage applied. As the liquid crystal, a TN liquid crystal is used in the same way as in FIG. 7. In this TN liquid crystal, a deflecting plate is used, though it is omitted in the same way as in FIG. 7.

The symbol 58 represents a liquid crystal display portion support frame for supporting the liquid crystal display portion 55 at a position eccentric from the hand shaft 13. The liquid crystal display portion support frame 58 is disposed on a circuit substrate 19. By this, an electroconductive rubber 20 is pressure-welded to the circuit substrate 19 via the upper glass substrate 56. The liquid crystal display portion support frame 58 is entirely composed of a light transmittable resin such as a polystyrene, polycarbonate, polysalcon, acrylate, nylon or the like and can be formed by a plastic molding process.

By this, the liquid crystal display portion support frame 58 entirely constitutes a light transmission portion. The hand shaft display portion is illuminated by an EL element (described below) through the light transmission portion. Also, the liquid crystal display portion support frame 58 is provided with a shaft insertion hole 58*a* for inserting the hand shaft 13 and a penetration window 58*b* facing the liquid crystal display portion 55. Among these materials, the penetration window 58*b* constitutes a light transmission portion through which the liquid crystal display portion 55 is illuminated by the EL element (described below). The electroconductive rubber 20 is compressed in the direction parallel to the axis of the penetration window 58*a*. The two terminals of the electroconductive rubber 20 are electrically connected to an electrode output portion 56*a* of the upper glass substrate 56 and an electrode 19*a* of the circuit substrate 19 respectively. Incidentally, a dial (not shown) constituting a part of the hand shaft display portion 11 is disposed above (hand side) the liquid crystal display portion support frame 58.

The symbol 61 represents an EL film as an EL element for illuminating the liquid crystal display portion 55 from below (opposite to the hand side). The EL film 61 is disposed between the lower glass substrate 57 and the movement 14 and electrically connected to the circuit substrate 19 through a pressure coil spring 22. The EL film 61 is composed of a film having a structure in which particles of a fluorescent material such as zinc sulfide (ZnS) or the like is sealed with a transparent insulating resin and the resulting sealed particles are sandwiched between a transparent electrode and a reflector. The EL film 61 emits light from the application of an a.c. voltage of from 25 to 75 V and is utilized as a back light for the liquid crystal display portion equipment. The EL film 61 is provided with a shaft insertion hole 61*a* for inserting the hand shaft 13 and a rubber insertion hole 61*b* for inserting the electroconductive rubber 20.

The symbol 63 represents a battery as a power source for the hand shaft display portion 11 and the liquid crystal display portion 55. The battery 63 is composed of a small battery such as a lithium battery, silver battery, and the like and attached to the circuit substrate 19 using a plate spring 64 to apply pressure to the battery.

In the combination display timepiece equipped with EL illumination formed in the above manner, the movement 14 is driven by a signal from a source transmitter and the driving force is transferred to the hand 12 through the hand shaft 13, thereby indicating the time analogously. In the same way, a voltage is applied to the liquid display 55 from the circuit substrate 19 through the electroconductive rubber 20 by a signal from a source transmitter, thereby indicating the time digitally.

By these measures, the hand shaft display portion 11 and the liquid crystal display portion 55 can be viewed to determine the time in general under the condition where the EL film 61 is turned off. Also, even in the case of dark conditions such as at night or the like, the hand shaft display portion 11 and the liquid crystal display portion 55 can be viewed with certainty to determine the time under the condition where the EL film 61 is turned on by an SW (not shown).

Figure 8:
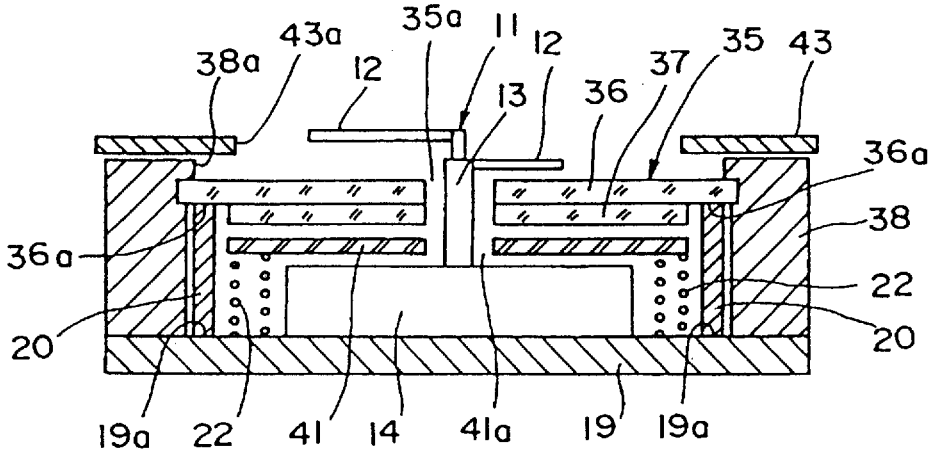
FIG. 8 Prior Art
FIG. 8 is a sectional view showing a major part of an internal device (module) of a combination display timepiece equipped with EL illumination corresponding to a second prior art, in which the casing for the watch, the inside of the movement, and the like are omitted.

Also, because the first embodiment is not applicable to a watch of the type utilizing a full liquid crystal display portion such as shown in FIG. 8, it is unnecessary to process a liquid crystal cell to provide a shaft insertion hole therein in the same manner as in the conventional types. Therefore, the processing costs can be reduced.

Also, in the first embodiment, it is not necessary to provide a shaft insertion hole in a liquid crystal cell so that the conventional impact resistant structure is not required, leading to a reduction in the manufacturing cost.

Furthermore, in the first embodiment, in which a full liquid crystal display portion is not adopted, the entire watch display is not covered with a deflecting plate and the area occupied by the liquid crystal display portion is smaller than the area occupied by the full liquid crystal display portion. Hence, there are the advantages that the brightness of the whole liquid crystal display portion is high and the product value is promoted.

In addition, because a TN liquid crystal is used in the first embodiment of the present invention, two upper and lower deflecting plates are provided. Deflecting plates having a visible ray transmittance of the order of from 35 to 55% are often used depending on the application. For example, when the visible ray transmittance of the liquid crystal display portion 55 is 42%, 42% of the visible ray emitted from the EL film 61 is transmitted to the liquid crystal display portion 55 and 58% of the visible ray is absorbed. In this case, if a deflecting plate with a comparatively high visible ray transmittance is used, the brightness of the display is higher, but the display contrast (ratio of brightness to darkness) is lower.

Also, in the first embodiment of the present invention, the visible ray transmittance of the liquid crystal display portion support frame 58 is adjusted to balance the light transmitted from the hand shaft display portion 11 and the liquid crystal display portion 55 respectively corresponding to the light emitted from the EL film 61. The methods of adjustment include a plastic molding method using a light transmittable resin to which coloring matter is added, a plastic molding method using a light scattering resin, a plastic molding method in which the cavity surface of a molding die is processed to make a roughened surface in advance to provide light scattering on the surface of the liquid crystal display portion support frame 58, a method of printing a semi-transmittable film on the surface of the liquid crystal display portion support frame after plastic molding, and combinations, of these methods.

The visible ray transmittance of the liquid crystal display portion support frame 58 manufactured in the above manner is preferably in a range of from 30 to 92%. If the transmittance is less than 30%, light absorption of the liquid crystal display portion support frame 58 is large and hence the hand shaft display portion is too dark. The transmittance of the liquid crystal display portion support frame 58 is preferably in a range of from 30 to 70% to balance the visible ray transmittance of the liquid crystal display portion 55. Also, the transmittance of the liquid crystal display portion support frame 58 is preferably in a range of from 70 to 92% so that the brightness of the hand shaft display portion 11, which is frequently observed, is higher. If the transmittance is higher than 92%, the brightness is further increased, but specific processing of the reflecting film and the like is required, leading to a high cost.

Next, a combination display timepiece equipped with EL illumination corresponding to a second embodiment of the present invention will be illustrated with reference to the drawing.

Figure 2:
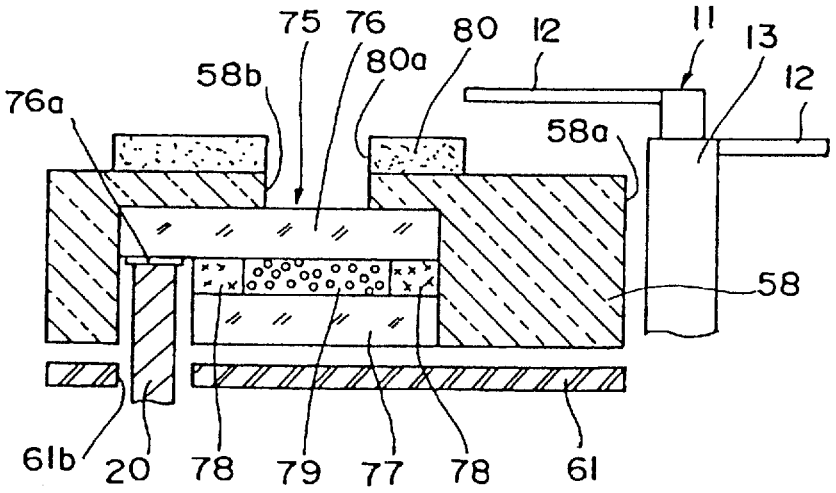
FIG. 2 is a sectional view showing a major part of an internal device (module) of a combination display timepiece equipped with EL illumination corresponding to a second embodiment of the present invention, in which the casing for the watch, the inside of the movement, and the like are omitted.

FIG. 2 is a sectional view showing a major part of an internal device (module) of a combination display timepiece equipped with EL illumination corresponding to the second embodiment of the present invention, in which parts other than a light absorbing material and a liquid crystal display portion are represented by the same symbols as in FIG. 1, and therefore detailed descriptions are omitted. Also, in FIG. 2, the casing for the watch, the inside of the movement, and the like are omitted.

In FIG. 2, the symbol 75 represents two liquid crystal display portions (only one of which is shown) for indicating time digitally. The liquid crystal display portion 75 includes two glass substrates 76, 77 which are stacked in the vertical direction (direction parallel to the axis of a hand shaft 13) and a liquid crystal 79 sealed between the glass substrates 76, 77 by a sealing material 78. The time is displayed by the electro-optic effect of the liquid crystal 79, which is controlled by the voltage applied. For the liquid crystal 79, a TN liquid crystal is used in the same way as in the first embodiment. In this TN liquid crystal, a deflecting plate is used, though it is omitted in the same way as in the first embodiment.

The symbol 80 represents a light absorbing material as a light absorbing portion, which is secured to and disposed on the periphery of the hand side of a penetration window 58*a* provided in a liquid crystal display portion support frame 58. The light absorbing material 80, which is formed on the liquid crystal display portion support frame at the side opposite to the EL film as a decorative opaque layer by pattern printing, attenuates or cuts the light emitted from an EL film 61. By this, the shadows of the seal material 78, an electrode output portion 76*a* of the upper glass substrate 76, and an electroconductive rubber 20, which are viewed from the side opposite the EL film of the liquid crystal display portion support frame 58 by the light emitted from the EL film 61 are shielded, thereby allowing the decorative appearance to be maintained. Such a shielding effect can be obtained, for example, by a method of mechanically installing the light absorbing material 80 on the liquid crystal display portion support frame 58 without using the above printing method.

The light absorbing material 80 is provided with a insertion hole 80*a* as a light transmission portion facing the liquid crystal display portion 75. The liquid crystal display portion 75 can be viewed from the side opposite to the EL film of the liquid crystal display portion support frame 58 through this insertion hole 80*a*.

Similar to the combination display timepiece equipped with EL illumination shown in FIG. 1, in a combination display timepiece equipped with EL illuminationes formed in the above manner, the movement 14 is driven by a signal from a source transmitter and the driving force is transferred to the hand 12 through the hand shaft 13, thereby indicating the time analogously. In the same way, a voltage is applied to the liquid display 75 from the circuit substrate 19 through the electroconductive rubber 20 by a signal from a source transmitter, thereby indicating the time digitally.

By these measures, the hand shaft display portion 11 and the liquid crystal display portion 75 can be viewed to determine the time in general under the condition where the EL film 61 is turned off. Also, even in the case of dark conditions such as at night or the like, the hand shaft display portion and the liquid crystal display portion 75 can be viewed with certainty to determine the time under the conditions where the EL film 61 is turned on. These effects are similar to those in the combination display timepiece equipped with EL illumination shown in FIG. 1.

Also, because the second embodiment is not applicable to a watch of the type utilizing a full liquid crystal display portion such as shown in FIG. 8, reductions in the processing costs and the manufacturing costs can be attained in the same way as in the first embodiment.

Also, in the second embodiment, in which a full liquid crystal display portion is not adopted, there are the advantages that the brightness of the whole liquid crystal display portion is high and the product value is promoted in the same way as in the first embodiment.

Next, combination display timepiece equipped with EL illuminationes corresponding to third and fourth embodiments of the present invention will be illustrated with reference to the drawing.

Figure 3:
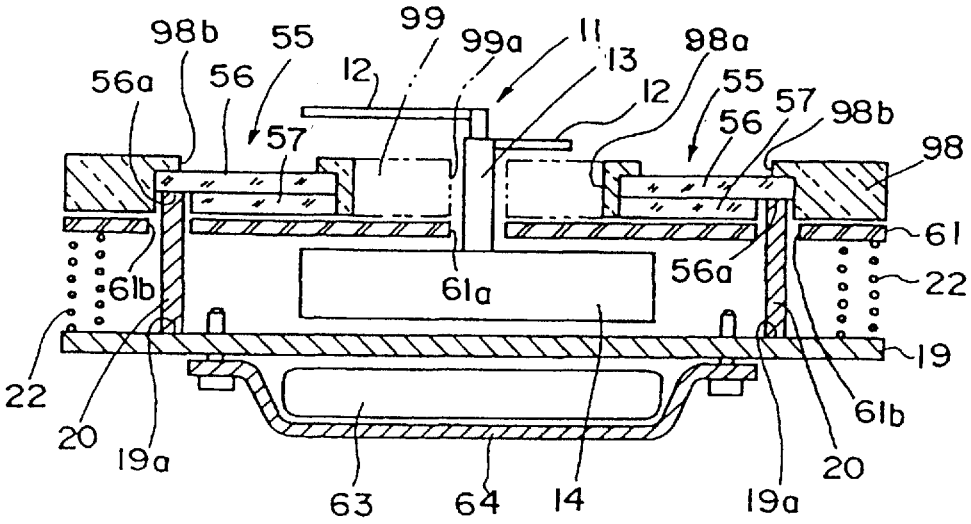
FIG. 3 is a sectional view showing a major part of an internal device (module) of a combination display timepiece equipped with EL illumination corresponding to third and fourth embodiments of the present invention, in which the casing for the watch, the inside of the movement, and the like are omitted.

FIG. 3 is a sectional view showing a major part of an internal device for a combination display timepiece equipped with EL illumination corresponding to the third and fourth embodiments of the present invention, in which parts other than a liquid crystal display portion support frame and a transparent material (fourth embodiment) are represented by the same symbols as in FIG. 1, therefore detailed descriptions are omitted. Also, in FIG. 3, the casing for the watch, the inside of the movement, and the like are omitted and, also, the transparent material shown as the two-dot chain line is not used in the third embodiment but used in the fourth embodiment.

First, illustrating the structure of the third embodiment, the symbol 93 represents a liquid crystal display portion support frame for supporting a crystal display 55 at a position eccentric from a hand shaft 13. The liquid crystal display portion support frame 98 is disposed on a circuit substrate 19. An electroconductive rubber 20 is pressure-welded to the circuit substrate 19 via an upper glass substrate 56. The liquid crystal display portion support frame 98 is entirely composed of a light transmittable resin such as polystyrene, polycarbonate, polysalcon, acryl, nylon or the like and can be formed by a plastic molding process.

The whole liquid crystal display portion support frame 98 constitutes a light transmission portion. A hand shaft display portion 11 is illuminated by an EL film 61 through the light transmission portion. Also, the liquid crystal display portion support frame 98 is provided with a shaft insertion hole 98*a* formed of an opening into which the hand shaft 13 is inserted and facing a part of the EL film 61, and a penetration window facing the liquid crystal display portion. Among these materials, the shaft insertion hole 98*a* constitutes a light transmission portion, through which the hand shaft display portion 11 is illuminated by the EL film 61.

On the other hand, a penetration window 98*b* constitutes a light transmission portion through which the liquid crystal display portion 55 is illuminated by the EL film 61. In addition, a dial (not shown) constituting a part of the hand shaft display portion 11 is disposed above (hand side) the liquid crystal display portion support frame 98 in the same way as in the first embodiment.

Next, illustrating the structure of the fourth embodiment, in FIG. 3, the symbol 99 represents a transparent material including a shaft insertion hole 99*a* for inserting the hand shaft 13. The transparent material 99 is installed in the shaft insertion hole 98*a* of the liquid crystal display portion support frame 98 as shown by the two-dot chain line. The transparent material 99 is entirely composed of a light transmittable resin such as polystyrene, polycarbonate, polysalcon, acryl, nylon or the like and can be formed by a plastic molding process in general in the same fashion as the liquid crystal display portion support frame 98. The transparent material 99 together with the liquid crystal display portion support frame 98 forms a light transmission portion. A hand shaft display portion 11 is illuminated by the EL film 61 through the light transmission portion.

In the combination display timepiece equipped with EL illuminationes of the third and fourth embodiments produced in the above manner, the hand shaft display portion 11 indicates the time analogously and the liquid crystal display portion indicates the time digitally in the same way as in the combination display timepiece equipped with EL illumination shown in FIG. 1.

Similar to the EL illuminated multiple display shown in FIG. 1, by these measures, the hand shaft display portion 11 and the liquid crystal display portion 55 can be viewed to determine the time in general under the condition where the EL film 61 is turned off. Also, even in the case of dark conditions such as at night or the like, the hand shaft display portion 11 and the liquid crystal display portion 55 can be viewed to determine the time under the condition where the EL film 61 is turned on.

Also, because the third and fourth embodiments are not applicable to a watch of the type utilizing a full liquid crystal display portion such as shown in FIG. 8, reductions in the processing costs and the manufacturing costs can be attained in the same way as in the first embodiment.

Also, in the third and fourth embodiments, in which a full liquid crystal display portion is not adopted, there are the advantages that the brightness of the whole liquid crystal display portion is high and the product value is promoted in the same way as in the first embodiment.

Next, a combination display timepiece equipped with EL illumination corresponding to a fifth embodiment of the present invention will be illustrated with reference to the drawing.

Figure 4:
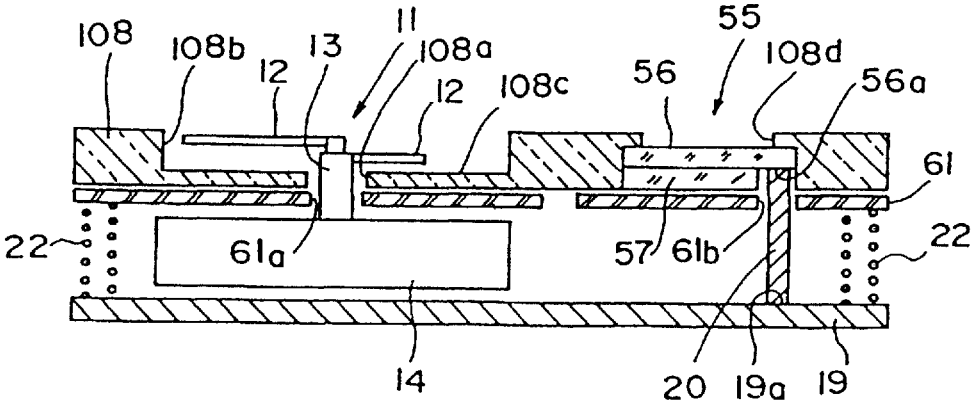
FIG. 4 is a sectional view showing a major part of an internal device (module) of a combination display timepiece equipped with EL illumination corresponding to a fifth embodiment of the present invention, in which the casing for the watch, the inside of the movement, and the like are omitted.

FIG. 4 is a sectional view showing a major part of an internal device of a combination display timepiece equipped with EL illumination corresponding to the fifth embodiment of the present invention, in which parts other than a liquid crystal display portion support frame are represented by the same symbols as in FIG. 1, therefore detailed descriptions are omitted. Also, in FIG. 4, the casing for the watch, the inside of the movement, and the like are omitted.

In FIG. 4, the symbol 108 represents a liquid crystal display portion support frame for supporting a crystal display 55 at a position eccentric from a hand shaft 13. The liquid crystal display portion support frame 108 is disposed on a circuit substrate 19. An electroconductive rubber 20 is pressure-welded to the circuit substrate 19 via an upper glass substrate 56. Similar to the liquid crystal display portion support frame 58 of the first embodiment, the liquid crystal display portion support frame 108 is entirely composed of a light transmittable resin such as polystyrene, polycarbonate, polysalcon, acryl, nylon or the like and can be formed by a plastic molding process in general.

The whole liquid crystal display portion support frame 108 constitutes a light transmission portion. A hand shaft display portion 11 is illuminated by an EL element 61 through the light transmission portion. Also, the liquid crystal display portion support frame 108 is provided with a shaft insertion hole 108*a* for inserting the hand shaft 13 and a space 108*b* communicating with the shaft insertion hole 108*a*. Among these materials, a space 108*b* is opened at a position (upper portion in FIG. 1) opposite to the EL film 61. Inside of the space 108*b*, a hand 12 is installed so that it is located on the same flat plane in the direction of the axis of the hand shaft 13 as the liquid crystal display portion 55. A part 108*c* forming the space 108*b* constitutes a light transmission portion through which the hand shaft display portion 11 is illuminated by the EL film 61.

Also, the liquid crystal display portion support frame 108 includes a penetration window 108*d* facing the liquid crystal display portion 55. The penetration window 108*b* constitutes a light transmission portion, through which the liquid crystal display portion 55 is illuminated by the EL film61. In addition, a dial (not shown) constituting apart of the hand shaft display portion 11 is disposed above (hand side) the liquid crystal display portion support frame 98 in the same way as in the first embodiment.

In the combination display timepiece equipped with EL illumination of the fifth embodiment formed in the above manner, the hand shaft display portion 12 indicates the time analogously and the liquid crystal display portion 55 indicates the time digitally in the same way as in the combination display timepiece equipped with EL illumination shown in FIG. 1.

Similar to the EL illuminated multiple display shown in FIG. 1, by these measures, the hand shaft display portion 11 and the liquid crystal display portion 55 can be viewed to determine the time in general when the EL film 61 is turned off. Also, even in the case of dark conditions such as at night or the like, the hand shaft display portion 11 and the liquid crystal display portion 55 can be viewed to determine the time when the EL film 61 is turned on.

Also, because the fifth embodiments is not applicable to a watch of the type utilizing a full liquid crystal display portion such as shown in FIG. 8, reductions in the processing costs and the manufacturing costs can be attained in the same way as in the first embodiment.

Further, in the fifth embodiment, in which a full liquid crystal display portion is not adopted, there are the advantages that the brightness of the whole liquid crystal display portion is high and the product value is promoted in the same way as in the first embodiment.

Next, a combination display timepiece equipped with EL illumination corresponding to a sixth embodiment of the present invention will be explained with reference to the drawing.

Figure 5:
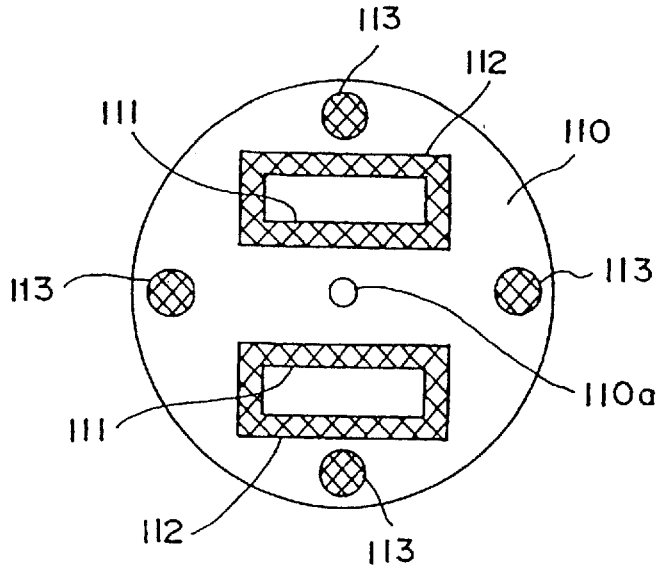
FIG. 5 is a top plan view schematically showing the dial of a combination display timepiece equipped with EL illumination corresponding to a sixth embodiment.
Figure 6:
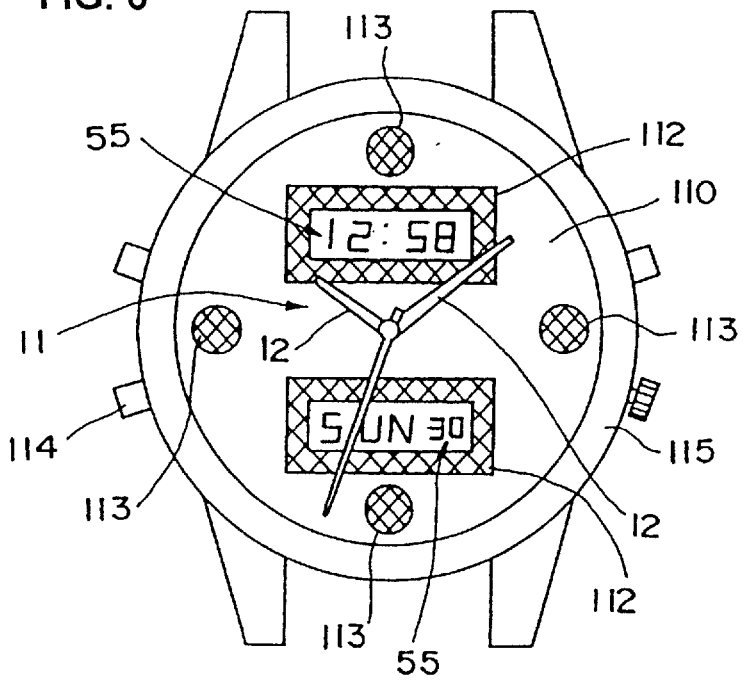
FIG. 6 is a top plan view schematically showing the combination display timepiece equipped with EL illumination with the dial shown in FIG. 5.

FIG. 5 is a top plan view schematically showing a dial of a combination display timepiece equipped with EL illumination corresponding to the sixth embodiment of the present invention. FIG. 6 is a top plan view schematically showing a combination display timepiece equipped with EL illumination incorporating the dial shown in FIG. 5. In FIGS. 5 and 6, a hand shaft display portion (including a hand and a hand shaft) and a liquid crystal display portion are represented by the same symbols as in FIG. 1, therefore detailed descriptions are omitted.

In FIG. 5, the symbol 110 represents a dial with a cyclically plane shape, which constitutes a part of a hand shaft display portion 11. The dial 110 is wholly formed of a light transmittable resin. The dial 110 is provided with two openings 111 facing a liquid crystal display portion 55. A light absorbing material 112 having the same functions as the light absorbing material 80 shown in FIG. 2 is formed on the periphery of the opening 111 at the position of the hand side by pattern-printing as a decorative opaque layer. By this light absorbing material 112, the shadows of a seal material, an electrode output portion of an upper glass substrate, and an electroconductive rubber (none of these parts are shown), which are viewed from the side opposite to an EL film 61 by the light emitted from the EL film 61 are shielded, thereby allowing the decorative appearance to be maintained.

Also, four dial marks 113 are formed on the dial 110 in an array at equal intervals along the circumference of the dial 110 by pattern-printing. In the center of the dial 110, a shaft insertion hole 110*a* for inserting a hand shaft 13 is provided.

The symbol 114 represents a push button for turning the EL film 61 on and off. The push button 114 is installed on a casing frame 115 in a freely operable condition. The push button 114 has return characteristics provided by a spring (not shown).

INDUSTRIAL APPLICABILITY OF THE INVENTION

As is clear from the above descriptions, the combination display timepiece equipped with EL illumination of the present invention can be effectively used for various types of watches which include a hand shaft display portion and a liquid crystal display portion and are also provided with an EL element for illuminating these displays.

What is claimed is:

1. A combination display timepiece equipped with EL illumination comprising:

a substrate, a hand shaft display portion disposed above the substrate and having hands and driving shafts for the hands, a liquid crystal display portion situated above the substrate, a liquid crystal display portion support frame situated above the substrate for supporting the liquid crystal display portion, said liquid crystal display portion support frame including a shaft insertion hole for allowing the driving shafts to pass therethrough, a penetration window located away from the shaft insertion hole and facing the liquid crystal display portion, and a light transmission member formed at least around the shaft insertion hole, and an EL element situated under the liquid crystal display portion support frame relative to the hands, said EL element illuminating the liquid crystal display portion and the hand shaft display portion through the light transmission member when the EL element is illuminated.

2. The combination display timepiece equipped with EL illumination according to claim 1, wherein said support frame is formed of a light transmittable material, and said EL element extends entirely under the support frame and the liquid crystal display portion.

3. The combination display timepiece equipped with EL illumination according to claim 1, wherein the EL element is disposed between the liquid crystal display portion and a movement for the hands.

4. The combination display timepiece equipped with EL illumination according to claim 1, wherein the shaft insertion hole is formed of an opening facing a part of the EL element.

5. The combination display timepiece equipped with EL illumination according to claim 4, wherein the shaft insertion hole is filled with the light transmittable member formed separately from the support frame.

6. The combination display timepiece equipped with EL illumination according to claim 1, wherein the hand and the liquid crystal display portion are located almost on a same flat plane in the direction parallel to axes of the drive shafts.

7. The combination display timepiece equipped with EL illumination according to claim 1, wherein a light absorbing material for attenuating or shielding illumination light emitted from the EL element is disposed on an electrode output portion and a liquid crystal seal portion of the liquid crystal display portion at a side of the hands.

8. The combination display timepiece equipped with EL illumination according to claim 1, wherein the liquid crystal display portion support frame is formed of a light transmitting material having a visible ray transmittance of from 30 to 92%.

9. The combination display timepiece equipped with EL illumination according to claims 1, wherein a light transmission dial is disposed on the liquid crystal display portion support frame at a position opposite to the EL element.

10. The combination display timepiece equipped with EL illumination according to claim 9, wherein the dial is provided with a light absorbing material.

* * * * *